US008179365B2

(12) United States Patent
Lee et al.

(10) Patent No.: US 8,179,365 B2
(45) Date of Patent: May 15, 2012

(54) ELECTROPHORETIC DISPLAY DEVICE HAVING IMPROVED COLOR GAMUT

(75) Inventors: Jeong-Kuk Lee, Yongin-si (KR); Sung-Jin Kim, Seongnam-si (KR); Jae-Byung Park, Seongnam-si (KR); Son-Uk Lee, Yongin-si (KR); Seul Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 747 days.

(21) Appl. No.: 12/255,900

(22) Filed: Oct. 22, 2008

(65) Prior Publication Data

US 2009/0109172 A1 Apr. 30, 2009

(30) Foreign Application Priority Data

Oct. 26, 2007 (KR) ..... 10-2007-0108097

(51) Int. Cl.
*G09G 3/34* (2006.01)

(52) U.S. Cl. ..... 345/107

(58) Field of Classification Search ..... 345/173, 345/107; 359/296
See application file for complete search history.

(56) References Cited

U.S. PATENT DOCUMENTS

| | | | | |
|---|---|---|---|---|
| 2002/0015110 | A1* | 2/2002 | Brown Elliott | 348/589 |
| 2002/0054263 | A1* | 5/2002 | Kim et al. | 349/123 |
| 2002/0097357 | A1* | 7/2002 | Huang et al. | 349/113 |
| 2003/0071943 | A1* | 4/2003 | Choo et al. | 349/106 |
| 2004/0155857 | A1 | 8/2004 | Duthaler et al. | |
| 2004/0169807 | A1* | 9/2004 | Rho et al. | 349/139 |
| 2005/0068477 | A1* | 3/2005 | Shin et al. | 349/106 |
| 2005/0094248 | A1* | 5/2005 | Katase | 359/296 |
| 2006/0061530 | A1* | 3/2006 | Yuasa | 345/88 |
| 2007/0013649 | A1* | 1/2007 | Kim et al. | 345/107 |
| 2007/0024954 | A1* | 2/2007 | Sakamoto | 359/296 |
| 2009/0040190 | A1* | 2/2009 | Nihei et al. | 345/173 |

FOREIGN PATENT DOCUMENTS

| | | |
|---|---|---|
| JP | 2006-243399 | 9/2006 |
| KR | 10-0634508 | 10/2006 |

* cited by examiner

*Primary Examiner* — Quan-Zhen Wang
*Assistant Examiner* — Tony Davis
(74) *Attorney, Agent, or Firm* — Innovation Counsel LLP

(57) ABSTRACT

An electrophoretic display device has a first substrate that defines a plurality of sub-pixel areas; with shaped pixel electrodes formed in the sub-pixel areas. A second substrate is attached in facing relation to the first substrate during mass production. The second substrate has color filters of different colors (e.g., R, G, B). The areas of the color filters are less than the areas of their corresponding sub-pixel electrodes so as to thereby avoid or reduce a color mixture effect that may arise from mass production misalignment between the first and second substrates. In one class of embodiments, area consumed by the color filters is less than about 75% but more than about 45% of area consumed by respective pixel areas. Each pixel area comprises a white (W) sub-pixel area in addition to the differently colored sub-pixel areas (e.g., R, G, B).

20 Claims, 4 Drawing Sheets

ELECTROPHORETIC DISPLAY DEVICE HAVING IMPROVED COLOR GAMUT

CROSS-REFERENCE TO RELATED APPLICATION

This application claims priority from and the benefit of Korean Patent Application No. 10-2007-0108097, filed on Oct. 26, 2007, whose disclosure is hereby incorporated by reference for all purposes as if fully set forth herein.

BACKGROUND

1. Field of Disclosure

The present disclosure of invention relates to electrophoretic display devices, and more particularly to electrophoretic display devices structured to provide improved color gamut.

2. Technology Background

With rapid developments in the information age, information display devices have increasingly been used in a broad range of applications. Information display devices may include a liquid crystal display ("LCD") devices, electrophoretic display ("EPD") devices, plasma display panels, etc., which are connected to a digital computer or another source of image data.

In particular, the EPD device may be characterized as having high reflectivity and a high contrast ratio, and in distinction to conventional LCD devices, having no substantial limit as to user viewing angle. Accordingly, a user may experience the EPD device as displaying images as if it displays the images on paper. Unlike an LCD device, the EPD device does not require a polarizing plate, an alignment layer, liquid crystal, etc, where the latter result in increased costs and manufacturing complexities.

The conventional EPD device includes an electrophoretic layer containing microcapsules or barrier-type microcups in which white and black particles (or otherwise differently reflecting and absorbing particles) of respectively opposed electrical charge are formed. The charged particles move up and down so as to be more reflective on top (to display white) or to be more absorptive on top (to display a dark or black image are). Older EPD devices did not display various colors, just black and white areas. These older devices thus had difficulty in expressing much information with use of only black and white coloration. Although some newer EPD devices sport a structure in which plural color filters of different colorations are formed over the black-versus-white (absorptive versus reflective) electrophoretic layer regions, these devices suffer from lowered luminance because the amount of light (e.g., ambient light) that is reflected back to the user's eyes is substantially lowered due to all of the light passing through the color filters. Furthermore, an undesired color mixture effect may be generated due to misalignment of the color filters relative to a lower substrate that contains TFT-controlled pixel areas. The result is decreased luminance and reduced color gamut (ability of the display to display a full gamut of distinct colors).

SUMMARY

The present disclosure of invention provides an EPD device in which structures of a color filter and the underlying pixel unit are changed to improve luminance, improve color gamut and/or reduce the possibility of undesired color mixture.

An electrophoretic display device in accordance with the disclosure comprises: a first substrate defining a plurality of sub-pixel areas; sub-pixel electrodes formed in the sub-pixel areas of the first substrate; and corresponding color filters formed in a second substrate facing a subset of the sub-pixel electrodes of the first substrate, where a combined area of the color filters is less than a total area of the sub-pixel electrodes in a given pixel area. In one class of embodiments, at least one of the sub-pixel electrodes does not have a color filter above it and therefore that at least one sub-pixel electrode controls reflection/nonreflection of incident light rather than reflection/nonreflection of light that passed through a color filter.

In one class of embodiments, the color filters in each pixel area comprise first to third primary color filters for displaying for example, red, green, and blue sub-pixels, respectively.

In one class of embodiments, the first substrate comprises first to fourth sub-pixel control areas for selectively controlling the display of first to third primary colors (e.g., red, green, and blue) and for selectively controlling the display of uncolored reflected light (e.g., white), respectively.

In one class of embodiments, the first to fourth sub-pixel electrodes are encompassed in first to fourth sub-pixel areas of a given pixel and have the same shape as underlying first to fourth sub-pixel electrodes, but smaller areas.

In one class of embodiments, the first to fourth sub-pixel areas each have a same size and shape.

The first to fourth sub-pixel areas may be formed in tetragonal shapes.

In one class of embodiments, the first to third sub-pixel areas have the same size and same shape as each other while the fourth sub-pixel has an area that is less than that of one of the first to third sub-pixel areas.

In one class of embodiments, the first to third sub-pixel areas surround the fourth sub-pixel area.

The first to third sub-pixel areas may be formed in as irregular pentagon shapes and the fourth sub-pixel electrode may be formed in a triangular shape.

The first to third sub-pixel areas may be formed in a structure in which two hexagons are adjacent to each other and the fourth sub-pixel electrode is formed in a hexagonal shape.

The first substrate may include first to fifth sub-pixel control areas in each pixel area for controllably displaying red, green, blue, and white from the pixel area.

Two sub-pixel areas of the first to fifth sub-pixel areas may display the same color.

First to fifth sub-pixel electrodes may be formed in the first to fifth sub-pixel areas and have the same shape as the first to fifth sub-pixel areas.

The first to fourth sub-pixel areas may have the same size and the same shape, and the fifth sub-pixel area may have a corresponding area that is less than the area of one of the first to third sub-pixel areas.

The first to third color filters may have the same shape as the first to fourth pixel areas and each of the first to third color filters may be of lesser area than each of the first to fourth sub-pixel electrodes.

The first to fourth sub-pixel areas may surround the fifth sub-pixel area. The first to fourth sub-pixel areas may be formed in a pentagonal shape and the fifth sub-pixel electrode may be formed in a tetragonal shape.

The combined areas of sub-pixel color filters of a given pixel may occupy about 50 to 65 percent of the entire area of the pixel.

It is to be understood that both the foregoing description and the following detailed description are exemplary and explanatory and are not intended to limit the teachings of the present disclosure.

BRIEF DESCRIPTION OF THE DRAWINGS

The above features and aspects of the present disclosure will become apparent and more readily appreciated from the following description of the exemplary embodiments, taken in conjunction with the accompanying drawings, in which.

DETAILED DESCRIPTION

Figure 1:
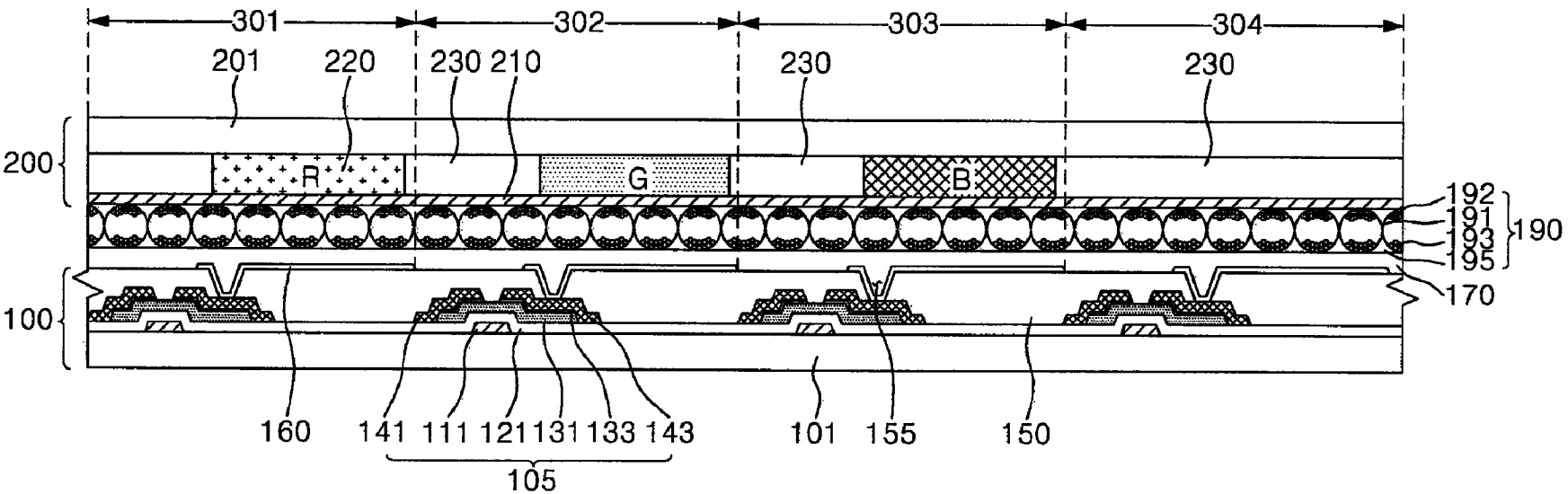
FIG. 1 is a cross sectional view illustrating an electrophoretic display ("EPD") device according to an exemplary embodiment.

FIG. 1 is a cross sectional view showing an electrophoretic display ("EPD") device according to an exemplary embodiment of the present disclosure.

Referring to FIG. 1, an EPD device includes a first substrate 100, an electrophoretic layer 190, and a second substrate 200.

The first substrate is organized to define respective primary color passing sub-pixels such as red ("R"), green ("G"), and blue ("B"), as well as a white ("W") sub-pixel area where these areas are respectively denoted as 301, 302, 303, and 304 and disposed in spaced-apart adjacent relation to one another. Various permutations of how these R, G, B, W sub-pixel areas may be organized relative to one another are shown in the top plan views of FIGS. 2-5. It is to be understood that the red ("R") sub-pixel area 301 does not display only as red, but rather may be variably controlled to display in a range from red to black (or to another light absorbing coloration). Similarly, the green ("G"), blue ("B"), and white ("W") sub-pixel areas may be each variably controlled to display in a range from their base color (or all colors, white) to black (or to another light absorbing coloration). As seen in FIG. 1, the first substrate 100 includes a lower substrate 101, thin film transistors ("TFT") containing layer 105, a protective layer 150, and a plurality of sub-pixel electrodes 160.

The lower substrate 101 may be formed of an electrically insulating material such as glass or plastic.

The TFTs 105 are formed in the R, G, B and W sub-pixel areas 301, 302, 303, and 304. Each of the TFTs 105 includes a gate electrode 111 formed on the lower substrate 101, a gate insulating layer 121, an active layer 131 (e.g., semiconductive layer), an ohmic contact layer 133, a source electrode 141, and a drain electrode 143.

The gate electrode 111 is connected to a gate line. The gate line is extendedly formed in one direction on the lower substrate 101. The gate insulating layer 121 is formed of an electrically insulating material on the gate electrode 111 and the gate line. For example, the gate insulating layer 121 is formed of a silicon nitride SiNx or a silicon oxide SiOx or a silicon oxynitride ($SiO_xN_y$) on essentially the whole surface of the lower substrate 101.

The active layer 131 formed on the gate insulating layer 121 overlaps the gate electrode 111. For example, the active layer 131 is formed of amorphous silicon (a-Si) on the gate insulating layer 121. Alternatively, the active layer 131 may be formed of polycrystalline silicon. In one embodiment, the ohmic contact layer 133 is formed of impurity-doped amorphous silicon on the active layer 131.

The source electrode 141 is connected to a data line on the gate insulating layer 121 and the ohmic contact layer 133 and overlaps the gate electrode 111. The drain electrode 143 overlaps the gate electrode 111 and faces the source electrode 141. The source electrode 141 and the drain electrode 143 are formed of the same material as that of the data line.

The protective layer (passivation layer) 150 is formed for insulation and passivation on the gate insulating layer 121, the active layer 131, the source electrode 141, and the drain electrode 143. The protective layer 150 is formed of at least one of an inorganic protective layer material and an organic protective layer material to improve the insulation and turn-off characteristics of the TFT 105. The protective layer 150 includes a contact hole 155 through which a portion of the drain electrode 143 is exposed.

Each sub-pixel electrode 160 is formed on the protective layer 150 and connected to the drain electrode 143 of the corresponding TFT 105 via the contact hole 155. In one embodiment, the sub-pixel electrode 160 is formed of a transparent conductive material, for example, indium tin oxide (ITO) or indium zinc oxide (IZO). Respective sub-pixel electrodes 160 are formed within the R, G, B, and W sub-pixel areas 301, 302, 303, and 304.

The electrophoretic layer 190 includes microcapsules 191 and an appropriate suspension solvent 195.

The microcapsules 191 include charged color particles, for example, black particles 192 charged with positive polarity and white particles 193 charged with negative polarity. When voltages are applied to an opposed pair of electrodes around the microcapsules (e.g., to a common electrode 210 and sub-pixel electrode 160) and an electric field is formed by the potential difference between the two electrodes, the black (light absorbing) particles 192 and the white (light reflecting) particles 193 respectively move towards the electrode of opposite polarity within each microcapsule. Then the charged light-reflecting/absorbing particles that preferentially move to the top (closer to the common electrode 210) reflect or absorb externally-provided incident light and the transparent microcapsules 191 consequently display images such as represented by black or white.

The capsule suspension solvent 195 surrounds the microcapsules 191 and is used to protect the microcapsules 191 from an external shock and it also fixes the microcapsules 191 one to the next so as to form the electrophoretic layer 190.

The electrophoretic layer 190 is attached to the first substrate 100 through an appropriate adhesive 170.

The second substrate 200 includes an upper substrate 201, a common electrode 210, a color filters layer 220, and an overcoat layer 230.

The upper substrate 201 is formed of an insulating material, such as glass or plastic, like the lower substrate 101. The upper substrate 201 may be formed of flexible plastic.

The common electrode 210 is formed of a transparent conductive material over the whole surface of the upper substrate 201. Like the pixel electrode 160, the common electrode 210 may be formed of ITO or IZO. The common electrode 210 forms an electric field together with the sub-pixel electrode 160 to control the movement of the black particles 192 and the white particles 193 of the electrophoretic layer 190.

The color filters layer 220 is disposed between the upper substrate 201 and the common electrode 210. The color filters layer 220 includes R, G, and B color filters for displaying primary colors such as R, G, and B colors, respectively.

Each color filter in layer 220 is formed to be smaller than the corresponding sub-pixel electrode 160 so as to prevent color mixture and color spreading caused by misalignment of the first substrate 100 and the second substrate 200 and by fringe electric fields between the sub-pixel electrodes 160 and the common electrode 210. "Color mixture" is an undesirable phenomenon that displays an unwanted color as well as a wanted specific color, caused by misalignment of the sub-pixel electrode 160 and the overlying color filters 220 upon bonding the first substrate 100 and the second substrate 200. "Color spreading" is an undesirable phenomenon that displays a color of reflective light throughout a wider range than an area of the color filter 220, and may be caused by an enlarged driving range of the electrophoretic layer 190. Such color spreading deteriorates color characteristics since the electrophoretic layer 190 negatively affects other pixels while a driving rage of the electrophoretic layer 190 is extended by fringe electric fields.

The color filter 220 is formed to correspond to a shape of the pixel electrode 160. The color filter 220 may be formed in the shape of a reduced version of the sub-pixel electrode 160.

Since the R, G, and B color filters 220 are formed separate from one another, this arrangement can prevent or reduce color mixture caused by reflective light being diffuse-reflected (or diffuse refracted) from the electrophoretic layer 190. In addition, the R, G, and B color filters 220 have spaces in preparation for alignment failure with the sub-pixel electrode 160 (to compensate for misalignment possibilities), thereby improving luminance and color gamut.

Figure 2:
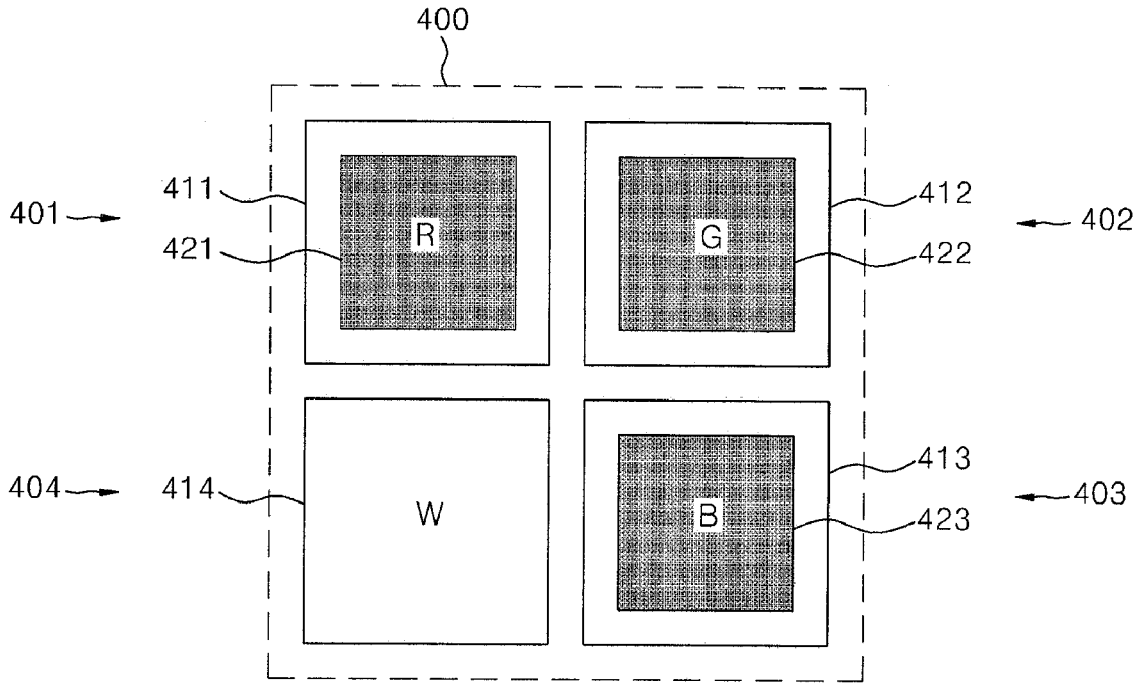
FIG. 2 is a top planar view illustrating a first sub-pixels structure of a first EPD device structured according to FIG. 1.

FIG. 2 is a view illustrating a sub-pixel structure of the EPD device of FIG. 1 according to a first exemplary embodiment.

Referring to FIG. 2, a pixel 400 of an EPD device includes first to fourth sub-pixels 401, 402, 403, and 404. Each sub-pixel has a tetragonal shape.

In the embodiment of FIG. 2, the first to fourth sub-pixels 401, 402, 403, and 404 have the same outer size and the same outer shape.

The first to third sub-pixels 401, 402, and 403 include first to third sub-pixel electrodes 411, 412, and 413, respectively and also include first to third color filters 421, 422, and 423, respectively. The first to third sub-pixel electrodes 411, 412, and 413 and the first to third color filters 421, 422, and 423 are formed as concentric tetragonal shapes. The first to third color filters 421, 422, and 423 are smaller in area than the first to third sub-pixel electrodes 411, 412, and 413. The first to third color filters 421, 422, and 423 may be formed of materials that selectively pass through the R, G, and B light wavelengths, respectively.

The fourth sub-pixel 404 has a tetragonal shape and includes a fourth sub-pixel electrode 414. The fourth sub-pixel 404 does not include any color filter and thus it will reflect white light when its underlying electrophoretic particles are white. Presence of the fourth sub-pixel 404 helps to improve the luminance of an image displayed by the pixel 400.

Since the first to third color filters 421, 422, and 423 are smaller in size than the corresponding first to third sub-pixel electrodes 411, 412, and 413, the structure of the pixel 400 prevents color mixture from being caused by slight misalignments of the first and second substrates and/or by diffused light reflection or refraction from the electrophoretic layer.

In one class of embodiments, the combination of areas of the first to third color filters 421, 422, and 423 may be formed to be substantially less than about 75% of the area of the pixel 400 so as to thereby prevent color mixture being caused by misalignment with the first to third sub-pixel electrodes 411, 412, and 413. For example, in one embodiment, the combination of areas of the first to third color filters 421, 422, and 423 may occupy about 45% to about 55% of the area of the pixel 400 (e.g., $45\% \leqq R+G+B \leqq 55\%$ of total pixel area), and nominally around 50% of the area of the pixel 400. It has been found that when the light controlling combined area of the first to third color filters 421, 422, and 423 is substantially less than 45% of the light passing area of the pixel 400, a color characteristic deteriorates. When the area of the first to third color filters 421, 422, and 423 is substantially greater than about 55% of the area of the pixel 400, a color mixture avoiding effect decreases. When the total area of the first to third color filters 421, 422, and 423 is in the nominal range centered at about 50% of the area of the pixel 400, the desired color mixture avoiding effect and color luminance characteristics are both obtainable.

The percentage of combined area of the first to third color filters 421, 422, and 423 (R+G+B) relative to the total area occupied by the pixel 400 is variable as a function of one or more of: (1) the spacing intervals provided between the first to fourth sub-pixels 401, 402, 403, and 404, and (2) the individual sizes of the first to third sub-pixel electrodes 411, 412, and 413. The area allotted to each of the first to third color filters 421, 422, and 423 may vary depending on the entire size of the EPD device.

The first to fourth sub-pixels 401, 402, 403, and 404 have been described thus far as including only the first to fourth sub-pixel electrodes 411, 412, 413, and 414 and the first to third color filters 421, 422, and 423. However, definition of the first to fourth sub-pixels 401, 402, 403, and 404 may further include corresponding portions of the first and second substrates, of the gate line, of the data line, of the associated TFT's, of the common electrode, etc.

Figure 3:
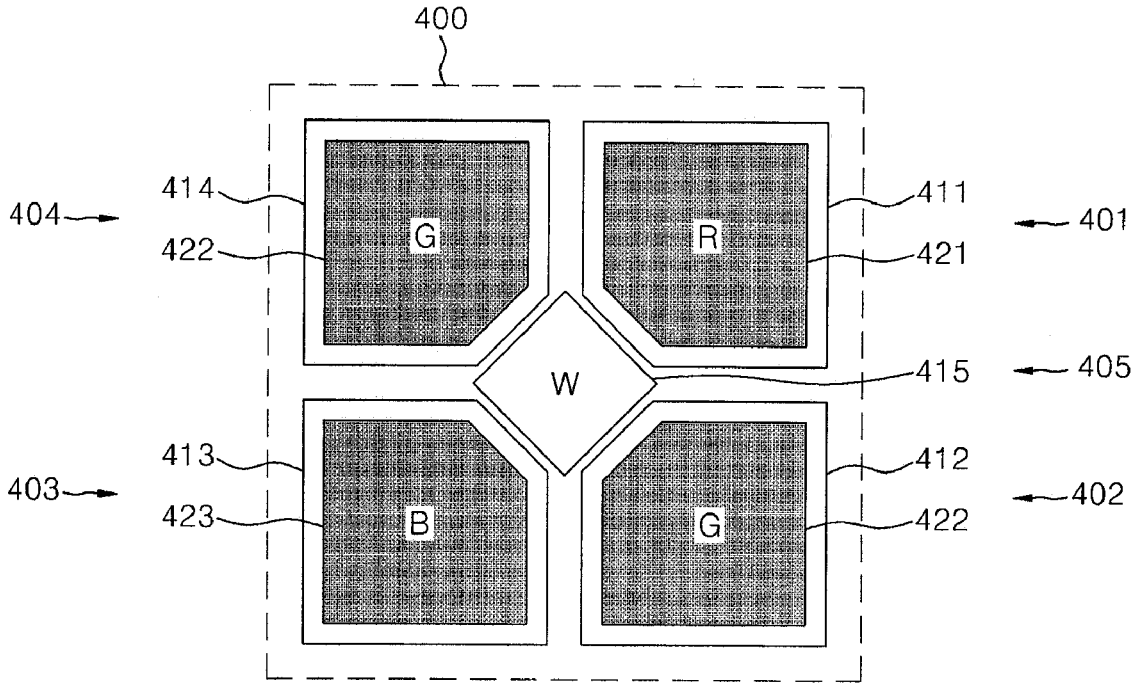
FIG. 3 is a top planar view illustrating a second sub-pixels structure for the EPD device of FIG. 1.

FIG. 3 is a second top planar view illustrating a second sub-pixel structure of the EPD device of FIG. 1 according to a second exemplary embodiment.

Referring to FIG. 3, the illustrated sub-pixel 400 includes first to fifth sub-pixels 401, 402, 403, 404, and 405 has a tetragonal shape.

The first to fourth sub-pixels 401, 402, 403, and 404 of FIG. 3 are identical to one another in size and shape and are arranged symmetrically around the differently shaped and/or differently sized fifth sub-pixel 405. The first sub-pixel 401 includes a first sub-pixel electrode 411 and a smaller, encompassed first color filter 421; the second sub-pixel 402 includes a second sub-pixel electrode 412 and a smaller, encompassed second color filter 422; the third sub-pixel 403 includes a third sub-pixel electrode 413 and a smaller, encompassed third color filter 423; and the fourth sub-pixel 404 includes a fourth sub-pixel electrode 414 and smaller, encompassed fourth color filter 422'. In one embodiment, the fourth color filter 422' is the same color (e.g., Green) as the diagonally opposed second color filter 422. In an alternate embodiment, the fourth color filter 422' may have a color passband that is substantially different from that of any of first through third color filters 421-423.

In FIG. 3, each of the first to fourth sub-pixel electrodes 411, 412, 413, and 414, and the first to third color filters 421, 422, and 423 is shaped as an irregular pentagon. The first to third color filters 421, 422, and 423 are smaller than the first to fourth sub-pixel electrodes 411, 412, 413, and 414. The first to third color filters 421, 422, and 423 may be formed of materials for displaying R, G, and B, respectively. The first to fourth sub-pixels 401, 402, 403, and 404 display R, G, B, and G, respectively. The second and fourth sub-pixels 402 and 404 identically display the G color, where this is selected to cause a user to perceive improved luminance and color gamut as compared to the arrangement of FIG. 2.

As seen in FIG. 3, the fifth sub-pixel 405 is formed at the center of the pixel 400. The fifth sub-pixel 405 is surrounded with the first to fourth sub-pixels 401, 402, 403, and 404. The fifth sub-pixel 405 is smaller in area than each of the first to fourth sub-pixels 401, 402, 403, and 404. The fifth sub-pixel 405 includes the fifth sub-pixel electrode 415 of a tetragonal shape. The fifth sub-pixel 405 displays the W color when activated to do us (or otherwise black), and as such it improves the luminance of an image achieved by the pixel 400 as compared to a pixel that does not have an independently controllable W sub-pixel region 405.

The pixel 400 of FIG. 3 is thereby structured to prevent or reduce the undesired color mixture effect caused by diffused-reflection of light through the electrophoretic layer, and/or caused by misalignment of the first and second substrates by forming the first to third color filters 421, 422, and 423 to be smaller in area than the corresponding first to fourth sub-pixel electrodes 411, 412, 413, and 414. Each area of the first to fourth sub-pixels 401, 402, 403, and 404 within the pixel 400 may be increased by forming the fifth sub-pixel 405 as being progressively smaller than each of the first to fourth sub-pixels 401, 402, 403, and 404. Since in the illustrated embodiment (FIG. 3), the pixel 400 includes the second and fourth sub-pixels 402 and 404 displaying the same G color, color gamut is improved. In addition, since color gamut is improved through presence of both the second and fourth sub-pixels 402 and 404, the thickness of the G-colored second color filter 422 can be reduced and a thickness difference that might otherwise be present between the other color filters and the G color filter, due to coloration density differences, may be decreased. In other words, the combined G-area that is provided per pixel is greater than the R area per pixel and greater than the B area per pixel, thereby allowing for different coloration densities in the respective R, G and B color filters.

An entire area of the first to third color filters 421, 422, and 423 combined may be about 60% to about 65% of an area of the pixel 400 in the embodiment of FIG. 3. Since the relative area occupied by the first to third color filters 421, 422, and 423 of FIG. 3 is greater than the relative area occupied by the first to third color filters 421, 422, and 423 of FIG. 2, (where the color filters are shaped as tetragons), the color gamut of FIG. 3 is improved over that of FIG. 2.

In FIG. 3, the percentage of combined area of the first to fourth color filters 421-423, 422' relative to the total area occupied by the pixel 400 is variable as a function of one or more of: (1) the spacing intervals provided between the first to fifth sub-pixels 401-405, and (2) the individual sizes of the first to fourth sub-pixel electrodes 411-414. The area allotted to the first to fourth color filters 421-423, 422' may vary depending on the entire size of the EPD device.

Although the first to fifth sub-pixels 401, 402, 403, 404, and 405 of FIG. 3 have been described as including the first to fifth sub-pixel electrodes 411, 412, 413, 414, and 415 and the first to third color filters 421, 422, and 423, definition of these sub-pixels is not limited thereto and may optionally include corresponding portions of the first and second substrates, a corresponding portion of the gate line, a corresponding portion of the data line, the corresponding TFT's, a corresponding portion of the common electrode, etc.

Figure 4:
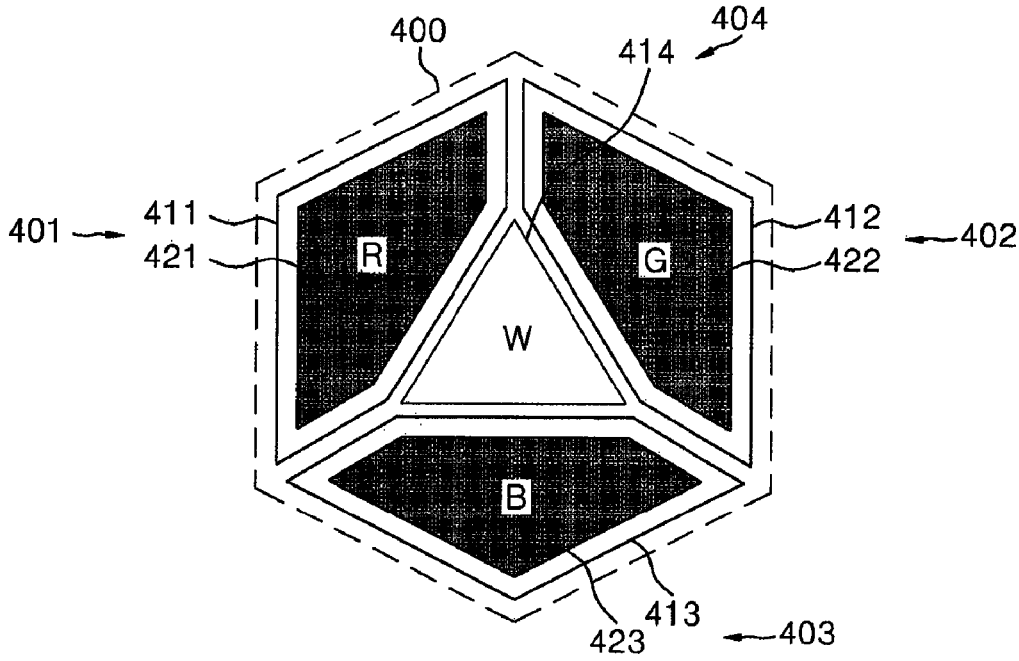
FIG. 4 is a top planar view illustrating a third sub-pixels structure for the EPD device of FIG. 1.

FIG. 4 is a top planar view illustrating a sub-pixel structure of the EPD device of FIG. 1 according to a third exemplary embodiment.

Referring to FIG. 4, a pixel 400 is formed in a hexagonal shape and includes first to fourth sub-pixels 401, 402, 403, and 404 tiled therein. As will be apparent to those skilled in the art from viewing the hexagonal shape of pixel 400, plural ones of such pixels 400 may be packed together or tessellated using a hexagonal packing scheme.

The first to third sub-pixels 401, 402, and 403 of FIG. 4 include first to third sub-pixel electrodes 411, 412, and 413, respectively and include first to third color filters 421, 422, and 423, respectively. Each of the first to third sub-pixel electrodes 411, 412, and 413 and the first to third color filters 421, 422, and 423 is shaped as an irregular pentagon that somewhat resembles a triangle. Each of the first to third color filters 421, 422, and 423 is smaller than each of the first to third sub-pixel electrodes 411, 412, and 413. The first to third color filters 421, 422, and 423 may be formed of materials for displaying R, G, and B, respectively. The first to third sub-pixels 401, 402, and 403 display R, G, and B, respectively.

The fourth sub-pixel 405 of FIG. 4 is formed at the center of the pixel 400. The fourth sub-pixel 404 is surrounded with the first to third sub-pixels 401, 402, and 403. The area of the fourth sub-pixel 404 is smaller than the area of each of the first to third sub-pixels 401, 402, and 403. The fourth sub-pixel 404 includes a fourth sub-pixel electrode 414 and is formed in a triangular shape. The fourth sub-pixel 404 displays W color.

The pixel 400 of FIG. 4 prevents color mixture caused by diffused reflection or refraction from the electrophoretic layer and/or due to misalignment of the first and second substrates by forming the first to third color filters 421, 422, and 423 as smaller in area than the respectively underlying first to third sub-pixel electrodes 411, 412, and 413. An area of the fourth sub-pixel 404 is formed to be smaller than each of the first to third sub-pixels 401, 402, and 403. Since a combined area (R+G+B) of the first to third sub-pixels 401, 402, and 403 may be about 65% of an area of the pixel 400, color gamut is improved. In addition, capability of expressing characters, diagonal lines, etc. of the pixel 400 is improved due to an optional hexagonal tiling/packing relationship with adjacent pixels (not shown).

Since the pixel 400 is formed in a polygonal structure similar to a circle, the edges of the pixel 400 is prevented from looking crushed or flattened as they might be in a rectangular format.

Although the first to fourth sub-pixels 401, 402, 403, and 404 have been described as including the first to fourth sub-pixel electrodes 411, 412, 413, and 414 and the first to third color filters 421, 422, and 423, the sub-pixels 401, 402, 403, and 404 may include first and second substrates, a gate line, a data line, a TFT, a common electrode, etc.

Figure 5:
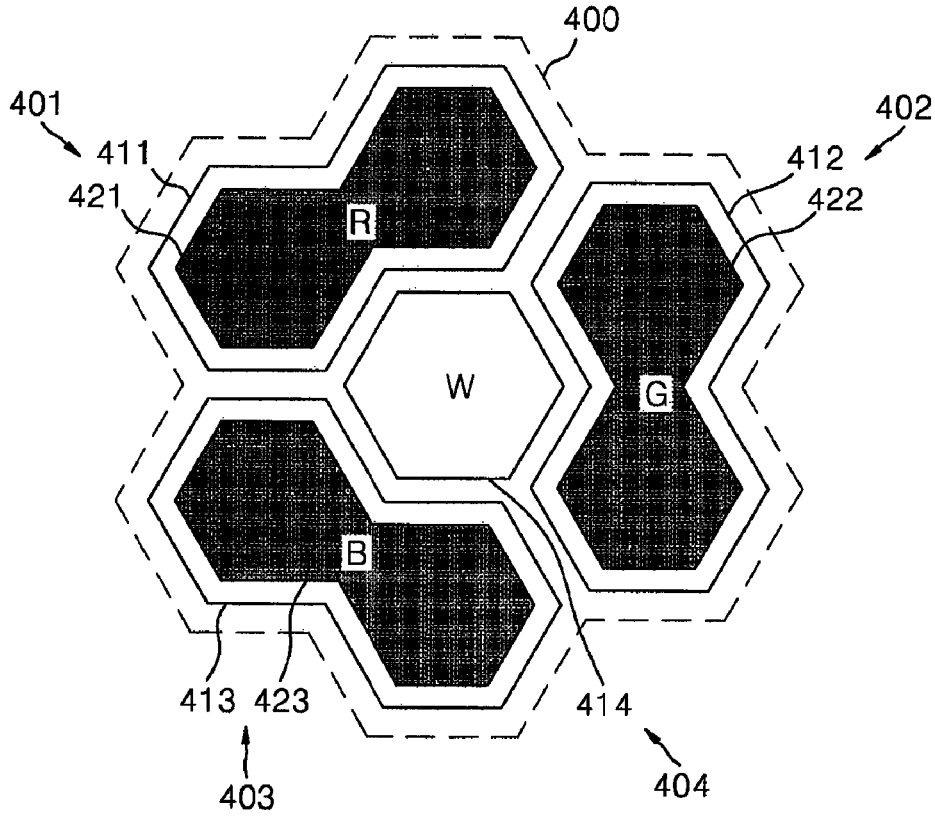
FIG. 5 is a top planar view illustrating a fourth sub-pixels structure for the EPD device of FIG. 1.

FIG. 5 is a view illustrating a sub-pixel structure of the EPD device of FIG. 1 according to a fourth exemplary embodiment.

Referring to FIG. 5, a pixel region 400 is formed in an octadecagonal shape (18 sides=3×6) and includes first to fourth sub-pixels 401, 402, 403, and 404.

The first to third sub-pixels 401, 402, and 403 includes first to third sub-pixel electrode 411, 412, and 413, respectively and includes first to third color filters 421, 422, and 423, respectively. The first to third sub-pixel electrodes 411, 412, and 413 and the first to third color filters 421, 422, and 423 each have a structure in which two hexagons abutted to each other at one edge. The first to third color filters 421, 422, and 423 are smaller in area than their respective first to third sub-pixel electrodes 411, 412, and 413. The first to third color filters 421, 422, and 423 may be formed of materials for displaying primary colors such as R, G, and B, respectively. Then the first to third sub-pixels 401, 402, and 403 selectively display R, G, and B, respectively.

The fourth sub-pixel 404 is formed at the center of the pixel 400. The fourth sub-pixel 404 is surrounded with the first to third sub-pixels 401, 402, and 403. The area of the fourth sub-pixel 404 is smaller than the area of each of the first to third sub-pixels 401, 402, and 403. The fourth sub-pixel 404 includes a fourth sub-pixel electrode 414 and is formed in a hexagonal shape. The fourth sub-pixel 404 selectively displays the W color.

The pixel 400 of FIG. 4 prevents color mixture caused by diffused-reflection/refraction of an electrophoretic layer and misalignment of the first and second substrates by forming the first to third color filters 421, 422, and 423 smaller than the first to third sub-pixel electrodes 411, 412, and 413. An entire area of the first to third sub-pixels 401, 402, and 403 may be about 60% to about 75% of an area of the pixel 400 by forming the fourth sub-pixel 404 smaller than each of the first to third sub-pixels 401, 402, and 403, thereby improving color gamut.

Since the first to fourth sub-pixels 401, 402, 403, and 404 and the first to third color filters 421, 422, and 423 may be formed by using a hexagonal mask, a manufacturing process is reduced and costs can be saved.

Although the first to fourth sub-pixels 401, 402, 403, and 404 have been described as including the first to fourth sub-pixel electrodes 411, 412, 413, and 414 and the first to third color filters 421, 422, and 423, the sub-pixels 401, 402, 403, and 404 may include first and second substrates, a gate line, a data line, a TFT, a common electrode, etc.

Figure 6:
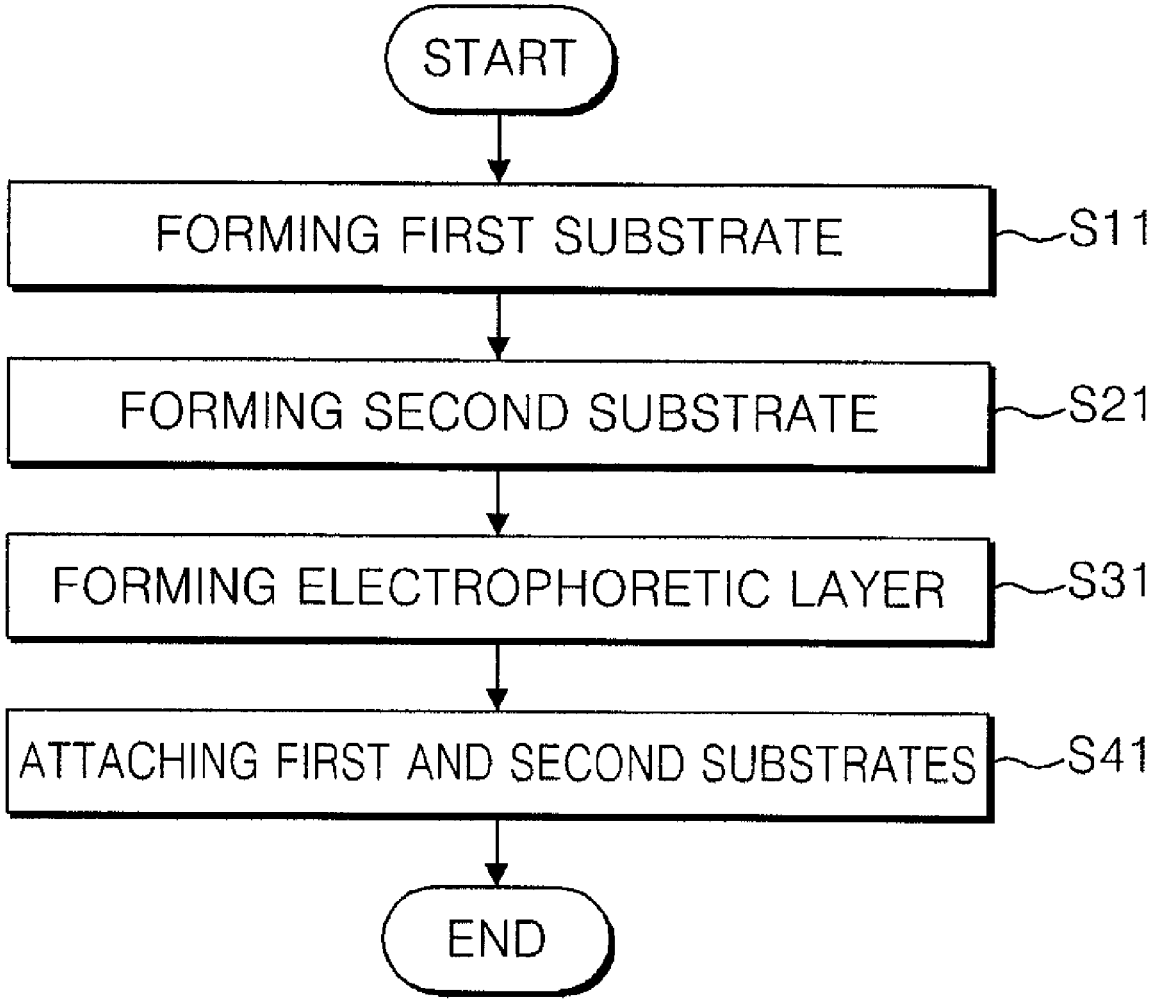
FIG. 6 is a flowchart illustrating a manufacturing process of an EPD device according to an exemplary embodiment.

FIG. 6 is a flowchart illustrating a manufacturing process of an EPD device according to an exemplary embodiment.

Referring to FIG. 6, the manufacturing process of an EPD device includes forming a first substrate (S11), forming a second substrate (S21), forming an electrophoretic layer (S31), and adhering the first and second substrates to each other (S41).

In step S11, a gate metal layer is deposited on a lower substrate by a deposition method such as sputtering. The gate metal layer is patterned by photolithography and etching processes to form a gate metal pattern group including a gate line and a gate electrode.

A gate electrode layer is formed on the lower substrate on which the gate metal pattern group is formed by plasma enhanced chemical vapor deposition ("PECVD").

An amorphous silicon layer and an impurity-doped amorphous silicon layer are deposited on the gate insulating layer. The amorphous silicon layer and the impurity-doped amorphous silicon layer are patterned to form an active layer and an ohmic contact layer.

Next, a data metal layer is deposited on the gate insulating layer and the ohmic contact layer. The data metal layer is patterned to form a gate metal pattern group including a data line, a source electrode, and a drain electrode.

At least one of an inorganic insulating material and an organic insulating material is deposited on the gate insulating layer and the data metal pattern group by a deposition method such as PECVD, thereby forming a protective layer. A contact hole is formed by etching the protective layer to expose a part of the drain electrode.

A transparent conductive material (e.g., ITO) is deposited on the protective layer and the transparent conductive material is patterned to form sub-pixel electrodes in for example the shapes described to be according to any one of FIGS. 2-5. Each sub-pixel electrode is connected to the respective drain electrode of its TFT through the corresponding contact hole.

In one embodiment, the sub-pixel electrode is formed to include a polygonal shape. For example, the polygonal portion of the sub-pixel electrode may be triangular, tetragonal, pentagonal, decagonal, etc., according to the desired shape of the sub-pixel.

In step S21, a pigment-colored filter for displaying a respective color such as one of R, G, and B is formed by coating a pigment-containing material (e.g., hardenable polymer) on an upper substrate and the so-deposited color filter pigment is patterned by a selective etching process so as to leave behind the desired pattern. Color filter pigments for displaying the other two colors are coated and patterned like the above described process, thereby forming R, G, and B color filters in the appropriate sub-pixel areas. In one embodiment, the R, G, and B color filters are formed in a polygonal shape like the pixel electrodes of sub-pixels. The R, G, and B color filters are formed to be smaller in area than the corresponding sub-pixel electrodes of respective sub-pixels and are spaced-apart from one another. For instance, the color filter may be formed as a scaled down replica (e.g., pentagon) of the underlying sub-pixel electrode.

In one embodiment, the R, G, and B color filters may be formed in an even-numbered polygonal shape such as tetragon, hexagon, octagon, etc. For example, the R, G, and B color filters may be formed in the shape of hexagonally-packable hexagons to thereby reduce the number of masks, leading to a reduction in a manufacturing process and costs. Namely, the number of processes, such as cleansing, photoresist deposition, development, exposure, baking, and ashing, is increased but the number of masks can be reduced.

A transparent organic or inorganic material is deposited on the upper substrate and the patterned color filters. A portion at which the R, G, and B color filters overlap the transparent organic or inorganic material is etched to form an overcoat layer. The overcoat layer has the same height (or a greater height) as that of the R, G, and B color filters and thus provides a substantially planar structure.

A transparent conductive material is deposited on the color filters and the overcoat layer to form a common electrode. For example, the common electrode is formed by depositing indium tin oxide (ITO) or indium zinc oxide (IZO) over the entire surface of the upper substrate.

In step S31, microcapsules and suspension solvent are mixed and then deposited on the second substrate. Next, an adhesive is applied on the microcapsules and suspension solvent. A release film is attached to the upper surface of the adhesive.

In step S41, the release film attached on the adhesive of the electrophoretic layer is removed. The first substrate, the second substrate, and the electrophoretic layer are attached to each other by a lamination method using a roller for example.

The EPD device according to the present disclosure forms color filters smaller in size than sub-pixels and has a separated distance between the color filters. Accordingly, the luminance of reflective light and color gamut may be prevented from being degraded, thereby improving display quality.

In addition, a W sub-pixel is formed to be smaller than each of R, G, and B sub-pixels and an area in which R, G, and B are displayed is enlarged, thereby improving color gamut.

Furthermore, since in some of the embodiments the each formed pixel (e.g., hexagon) is more similar to a circle than a square, the capability of expressing characters with slanted portions, diagonal lines, etc. with the more-circle like and efficiently packed pixels is improved and the edges of each pixel is prevented from looking like a crushed shape.

Although exemplary embodiments have been described in detail hereinabove, it should be clearly understood that many variations and/or modifications of the basic concepts taught herein will fall within the spirit and scope of the present disclosure of invention. Thus, it is intended that the present disclosure cover such various modifications and variations.

What is claimed is:

1. An electrophoretic display device, comprising:

a first substrate comprising a plurality of pixel areas, each pixel area of the plurality of pixel areas including a plurality of sub-pixel areas, the plurality of pixel areas including a first pixel area, the first pixel area including a first sub-pixel area, a second sub-pixel area, a third sub-pixel area, and fourth sub-pixel area for displaying a first color, a second color, a third color, and a fourth color, respectively, wherein the first, second, and third sub-pixel areas have the same size, and the fourth sub-pixel area is of lesser area than each of the first, second, and third sub-pixel areas;

sub-pixel electrodes formed in respective ones of the plurality of sub-pixel areas of the first substrate, the sub-pixel electrodes including a first sub-pixel electrode; and a plurality of differently colored sub-color filters corresponding to the sub-pixel electrodes and formed in a second substrate facing the first substrate, the plurality of differently colored sub-color filters including a first sub-color filter, where an area of the first sub-color filter is substantially less than an area of the first sub-pixel electrode.

2. The electrophoretic display device of claim 1, wherein the sub-color filters comprise first to third color filters for displaying red, green, and blue, respectively.

3. The electrophoretic display device of claim 2, wherein the first to fourth sub-pixel areas are configured for displaying red, green, blue, and white, respectively.

4. The electrophoretic display device of claim 3, wherein first to fourth pixel electrodes are formed in the first to fourth sub-pixel areas and have the same shape as the first to fourth sub-pixel areas.

5. The electrophoretic display device of claim 4, wherein the first to third color filters have the same shape as the first to third pixel electrodes and each of the first to third color filters is less than each of the first to third sub-pixel electrodes.

6. The electrophoretic display device of claim 5, wherein the first to fourth sub-pixel areas have the same size and shape.

7. The electrophoretic display device of claim 6, wherein the first to fourth sub-pixel areas are formed in a tetragonal shape.

8. The electrophoretic display device of claim 4, wherein the first to third sub-pixel areas have the same shape.

9. The electrophoretic display device of claim 8, wherein the first to third sub-pixel areas surround the fourth sub-pixel area.

10. The electrophoretic display device of claim 9, wherein the first to third sub-pixel areas are formed in a pentagon shape and the fourth sub-pixel electrode is formed in a triangular shape.

11. The electrophoretic display device of claim 9, wherein the first to third sub-pixel areas are formed in a structure in which two hexagons are abutted to each other and the fourth sub-pixel electrode is formed in a hexagonal shape.

12. The electrophoretic display device of claim 2, wherein the first substrate comprises first to fifth sub-pixel areas for displaying red, green, blue, and white.

13. The electrophoretic display device of claim 12, wherein at least two sub-pixel areas of the first to fifth sub-pixel areas display a same color.

14. The electrophoretic display device of claim 13, wherein first to fifth pixel electrodes are formed in the first to fifth sub-pixel areas and have the same shape as the first to fifth sub-pixel areas.

15. The electrophoretic display device of claim 14, wherein the first to fourth sub-pixel areas have the same size and the same shape, and the fifth sub-pixel is of lesser area than each of the first to third sub-pixel areas.

16. The electrophoretic display device of claim 15, wherein the first to third color filters have the same shape as the first to fourth pixel areas and each of the first to third color filters is less than each of the first to fourth sub-pixel electrodes.

17. The electrophoretic display device of claim 16, wherein the first to fourth sub-pixel areas surround the fifth sub-pixel area.

18. The electrophoretic display device of claim 17, wherein the first to fourth sub-pixel areas are formed in a pentagonal shape and the fifth pixel electrode is formed in a tetragonal shape.

19. The electrophoretic display device of claim 1, wherein said plurality of differently colored sub-color filters occupy about 50 percent to about 65 percent of area consumed by said plurality of sub-pixel areas.

20. An electrophoretic display having plural pixel areas whose light reflecting and/or light absorbing states are selectively controlled by plural sub-pixels disposed in each of the pixel areas, where each pixel area is characterized by:

having at least first, second, and third independently controlled sub-pixel areas that respectively comprise first, second, and third color filters of respective first, second, and third different colors for thereby respectively controlling luminance of colored lights therefrom, the first, second, and third sub-pixel areas having a first sub-pixel electrode, a second sub-pixel electrode, and a third sub-pixel electrode associated therewith, respectively, wherein the shape of the first sub-pixel electrode is the same as the shape of the first sub-pixel area in a top view of the electrophoretic display;

having at least one independently controlled, fourth sub-pixel area that does not comprise a color filter, the fourth sub-pixel area also having a sub-pixel electrode associated therewith;

wherein said first, second, and third color filters are spaced apart from one another so as to thereby avoid or reduce a color mixture effect that may arise from mass production misalignment of the first, second, and third color filters relative to the first, second, and third sub-pixel electrodes; and wherein each of said first, second, and third color filters is smaller in area than its associated sub-pixel electrode so as to thereby avoid or reduce said color mixture effect.

* * * * *